US005566138A

United States Patent [19]

Lombreschi et al.

[11] Patent Number: 5,566,138

[45] Date of Patent: Oct. 15, 1996

[54] COUNTER CIRCUIT FOR CONTROLLING THE OPERATION OF A QUARTZ CLOCK WITH "ONE TOUCH" OR "FAST" ELECTRICAL RESETTING OF THE TIME

[75] Inventors: Giampaolo Lombreschi, Turin; Massimiliano Brambilla, Sesto San Giovanni, both of Italy

[73] Assignees: SGS-Thomson Microelectronics, S.r.l., Agrate Brianza; Marelli Autronica S.p.A., Milan, both of Italy

[21] Appl. No.: 189,978

[22] Filed: Feb. 1, 1994

[30] Foreign Application Priority Data

Feb. 2, 1993 [FR] France ..... 93 01105

[51] Int. Cl.[6] ..... G04F 5/00; G04C 9/00

[52] U.S. Cl. ..... 368/157; 368/187

[58] Field of Search ..... 368/76, 80, 155–157, 368/160, 185–187

[56] References Cited

U.S. PATENT DOCUMENTS 4,117,663 10/1978 Mosimann et al. .
4,150,536 4/1979 Nakajima et al. .
4,185,453 1/1980 Jaunin .
4,261,048 4/1981 Motoki et al. .
4,351,042 9/1982 Ginalski et al. .
4,357,693 11/1982 Plancon et al. .
4,367,049 1/1983 Laesser et al. .
5,016,231 5/1991 Kawaguchi .

FOREIGN PATENT DOCUMENTS 2079012 1/1982 United Kingdom .

*Primary Examiner*—Vit W. Miska
*Attorney, Agent, or Firm*—Robert Groover; Betty Formby

[57] ABSTRACT

An electronic circuit for controlling an analog quartz clock, particularly for installation in automobiles, has first and second counters for generating control pulses at different rates according to whether the clock is to be operated in a normal mode, or a time-setting mode. In addition, a single 11-bit counter allows "fast" or "slow" resetting of the time by a single push button.

17 Claims, 2 Drawing Sheets

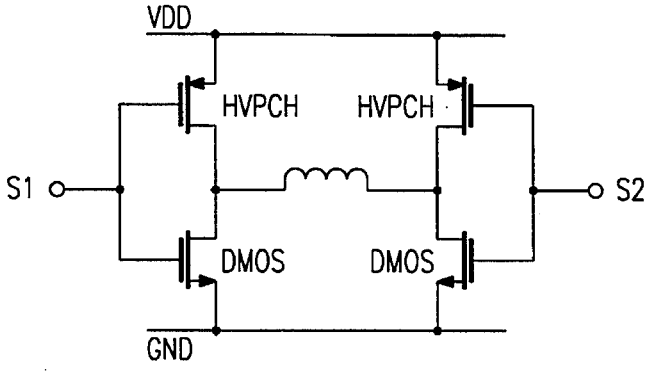
FIG. 1
(PRIOR ART)
FIG. 2
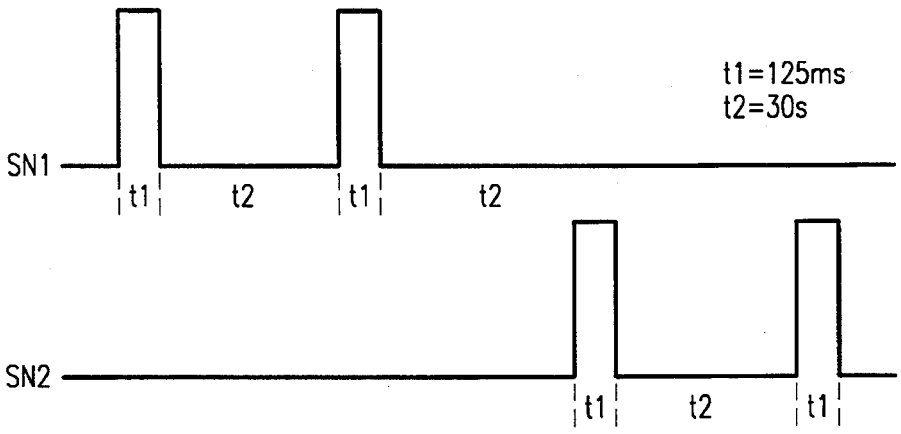
FIG. 3
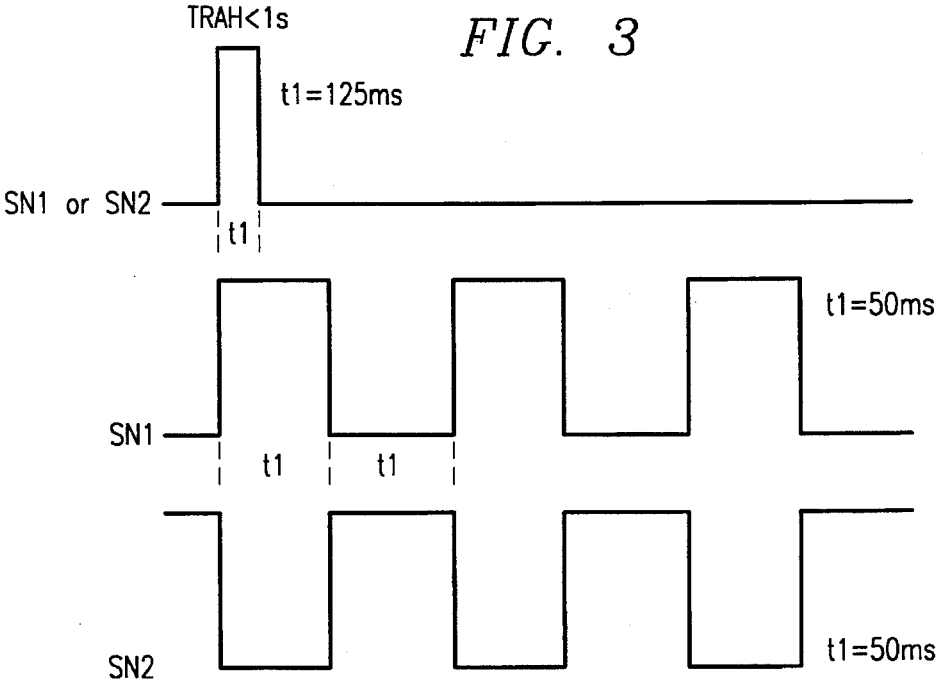

COUNTER CIRCUIT FOR CONTROLLING THE OPERATION OF A QUARTZ CLOCK WITH "ONE TOUCH" OR "FAST" ELECTRICAL RESETTING OF THE TIME

BACKGROUND AND SUMMARY OF THE INVENTION

The present invention relates to circuits for controlling clocks such as quartz electronic clocks. The circuit on which the present invention is based is derived from the need for a circuit which can generate a sequence of pulses for controlling the motor of a quartz clock which displays the time in analog manner (with hands).

The motors used in the production of these clocks can actuate a movement whenever the current flow through a winding is inverted.

FIG. 1 shows a typical connection diagram for one of these motors which uses MOS type transistors.

FIG. 2 shows the waveforms required for the correct operation in the event of the movement of the minute hands being controlled. The waveforms are given for two logic signals SN1 and SN2. As can be seen, both signals SN1 and SN2 have pulses t1 with square forms, with a high logic level ("1") and a duration of 125 ms separated by an interval t2, with a low logic level ("0") and a duration of 30 seconds. The two signals SN1 and SN2 are sent to two control terminals S1 and S2 respectively. As can be seen, the inversion of the direction of the current occurs every 60 seconds. In particular:

when S1=0 and S2=0 the winding is short-circuited and no movement is possible;

when S1=1 and S2=0 a diagonal is activated, and the hand is advanced by one minute;

when S1=0 and S2=1 the second diagonal is activated with the consequent inversion of the current in the winding, and it then becomes possible to advance the hand by a further minute.

The presence of the dual pulse is required in applications of an automotive nature in order to guarantee the movement of the hand in conditions of low supply voltage, typical of the starting phases of a car.

In conditions of normal operation, the second pulse does not generate any movement since there is no inversion of the current direction; conversely, the second pulse supplements the first pulse in the above low voltage conditions.

The "one touch" type resetting of the time is performed by activating a push button (not illustrated); each time the push button is pressed, which gives rise to a low logic level at a PULSE input (PULSE=0), the inversion of the current flow through the winding has to be ensured such that the hand is advanced by one minute. If the push button is activated for more than one second, the fast time resetting phase is entered, and a sequence of pulses with a period of 100 ms is enabled at the outputs.

FIG. 3 shows the wave forms relating to the time resetting phase. Assuming that the final pulse during normal operation has been sent to the output S2, the action on the push button will cause the output S1 to be activated.

In the prior art, the circuits used for solving the above-mentioned problem comprise interconnected contacts; implementation is achieved by the truth tables relating to each single function performed. Since 4 pulses of a duration of 125 ms and at 30 second intervals are to be generated from a 32 Hz clock, the following operations have to be performed:

counting 960 clock periods for the first 30 seconds;

counting 1920 clock periods for a time interval of 60 seconds from the first pulse;

resetting to zero and counting to 960 and 1920 again, taking account of the fact that the two successive pulses must be directed to the other output.

For the time resetting phase, a counter is used with the function of checking the duration of the action on the push button and two counters which, respectively, generate the individual pulses for the "slow" resetting of the time and the sequence of pulses for the "fast" time resetting phase.

The object of the present invention is to provide a circuit which can produce the sequence of control pulses during the various operating phases, illustrated in FIGS. 2 and 3, using a single counter, thus reducing the complexity and cost of the circuit.

In accordance with the present invention, this object is achieved by a circuit having the characteristics given specifically in the following claims.

In particular, the solution according to the invention optimizes the size in terms of areas of silicon on the integrated circuit, using a single 11-bit counter both for the normal operating phase and for the one touch time resetting phase, and, further, it performs the function of controlling the duration of the action on the push button.

BRIEF DESCRIPTION OF THE DRAWING

Further advantages and characteristics of the present invention will become clear from the following detailed description, given with reference to the appended drawings, provided solely by way of non-limiting example, in which:

FIGS. 1, 2 and 3 have already been described with reference to the prior art;

DETAILED DESCRIPTION

Figure 4:
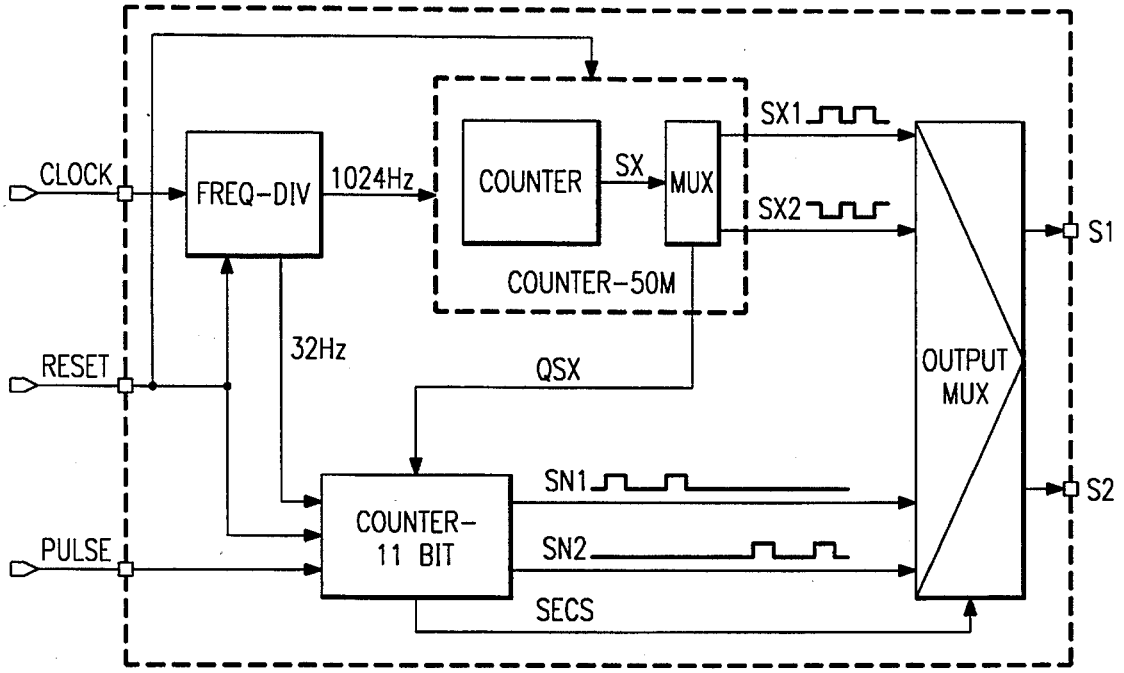
FIG. 4 is a schematic, block diagram of an embodiment of the circuit according to the present invention.
Figure 5:
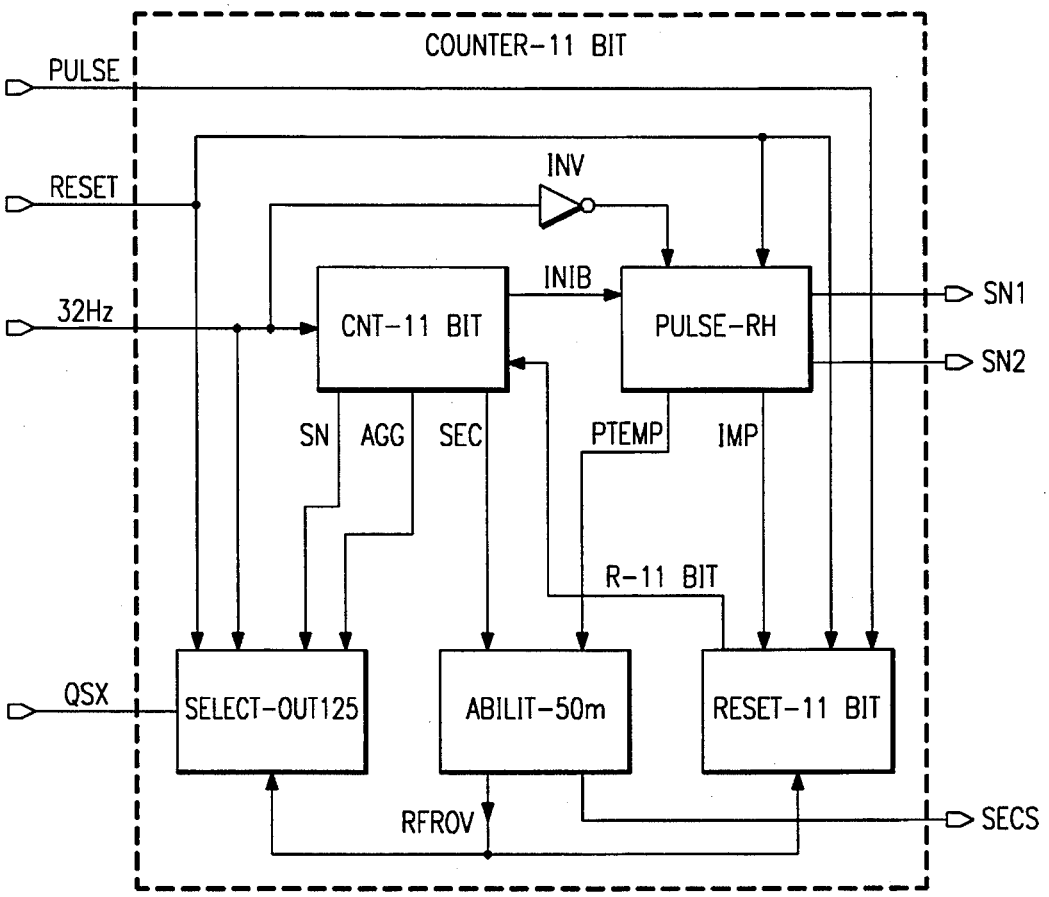
FIG. 5 is a schematic, block diagram of a portion of the circuit illustrated in FIG. 4.

An embodiment of the circuit according to the present invention will now be described with reference to FIGS. 4 and 5.

The circuit receives three signals at the input:

a signal CLOCK, for example at a frequency of 4 MHz;

a signal RESET; and a signal PULSE.

The signal CLOCK goes to a module, known as FREQ-DIV, which is an asynchronous frequency divider which generates two signals at the frequencies of 1024 Hz and 32 Hz, used in other sections of the circuit, from the frequency CLOCK generated by an external quartz oscillator, for example of $2^{22}$ HZ (4.194812 MHZ).

The module, known as the COUNTER-50M, comprises a counter COUNTER, synchronous with the falling edge of the 1024 Hz signal, which has a permanent cycle of 51 periods. It generates a signal, indicated SX, which is at logic high for 50 ms (50/1024 seconds) and at logic low for 1 ms (1/1024 seconds) and represents the basic signal for the fast time resetting pulses. Inside the module is, further, a multiplexer MUX which directs the signal SX alternately to the output SX1 or SX2.

A signal indicated QSX is generated by the multiplexer MUX and its logic value is determined by the output SX1 or SC2 previously activated; this information is used to update a finite state machine, which is known as SELECT-OUT 125 and will be described below.

A module, known as OUTPUT-MUX, is a multiplexer which, as a function of a signal SECS, directs both the fast time resetting signals SX (50 seconds) and the normal operation (slow time) resetting signals SN (125 ms) to two outputs S1 or S2 of the circuit.

The module COUNTER-11Bit, which receives the signals PULSE, RESET, QSX and 32 Hz, already described above, at its input further comprises some submodules and will now be described in greater detail with reference to FIG. 5.

The submodule indicated CNT-11Bit is a synchronous counter with a 60-second cycle operating on the basis of the 32 Hz signal. It generates the following signals:

SN, activated at logic high, for 125 ms (4/32 seconds) every 30 seconds: 4/32 seconds and (4/32+30) seconds from the beginning of the 60-second cycle, is a basic signal for the 125 ms pulses, both during normal operation and during slow time resetting;

SEC, activated at logic low, between one and two seconds after the beginning of the cycle, is a signal which provides the information necessary for passing to fast time resetting;

INIB, activated at logic low for the first 7/32 seconds of the cycle, is used to prevent activation of the time resetting push button acting on the multiplexing of the outputs whilst an SN command is in progress; and AGG, activated at logic low value for the first 1/32 seconds of the cycle, enables the destination of the signal SN at the outputs S1 and S2 to be updated during normal operation.

The PULSE-RH submodule is a finite state machine synchronized with the falling edge of the 32 Hz signal which, from the activation of the push button for resetting the time (PULSE signal brought to logic low), provided that INIB is not activated, generates the following signals:

IMP, activated at logic low for 31.25 ms (1/32 seconds) when the action on the push button is confirmed 62.5 ms after the 32 Hz signal has been detected by the falling edge, is one of the components which resets the CNT-11Bit submodule;

PTEMP, brought to logic low at the same time as the IMP signal, remains at zero for the entire duration of pressure on the push button.

Releasing the push button resets the PULSE-RH submodule.

As a function of the signals SEC and PTEMP and of the falling edge of the signal SX, the submodule ABILIT-50M generates the following signals:

SECS, activated at logic high in correspondence with the falling edge of the signal SX when the push button is activated for more than one second, is a signal which allows the pulses of the signal SX (50 ms) to be enabled at the output multiplexer OUTPUT-MUX, outputs SX1 and SX2;

RFROV, activated at logic low between the instant in which the signal PTEMP returns to logic high and the instant in which the signal SECS returns to logic low. The RFROV signal (reset for fast time resetting), is one of the components of the resetting signal of the submodule CNT-11Bit. This signal contributes to updating the direction of the pulse SN to signal SN1 or SN2.

The pulse SN is designated SN1 or SN2 below, depending on whether it is sent to the signal (or output) SN1 or SN2 respectively.

As a function of the signals QSx, RFROV, AGG, the submodule SELECT-OUT125 directs the signal SN to the correct output (SN1 or SN2). The multiplexing is synchronized with the falling edge of the 32 Hz signal which ensures that all the preceding control signals are stabilized.

A submodule RESET-11Bit is an AND gate having four inputs:

RESET (reset for switching on the circuit, "power-on");

IMP (reset for slow time resetting);

RFROV (reset for fast time resetting); and

PULSE.

At the output is a signal, R-11Bit, for resetting the submodule CNT-11Bit.

With reference to the above, the submodule CNT-11Bit has a 60-second cycle from the 32 Hz signal (T=31.25 ms) during which a pulse is generated (on the signal SN) for a duration of 125 ms every 30 seconds, and, before the following cycle begins, a signal AGG is generated which updates the destination of the signal SN at the output S1 or S2.

In practice, the above is carried out by an 11-bit counter which, instead of counting to 2048, counts 1920 positive transitions of the 32 Hz synchronous signal (60 s/31.25 ms). The pulses are generated in correspondence with the beginning of the cycle and when 960 synchronous signal transitions have been counted (30 s/31.25 ms). The pulse relating to the 60 seconds corresponds to the first pulse of the following cycle.

The decoding of the outputs for generating the pulses SN will now be described, in which SN2 indicates the pulse generated in correspondence with the initial phase of the cycle and SN1 indicates the pulse relating to the 30 seconds elapsed since the beginning of the cycle. In order to optimize the logic structure performing this function, it is considered opportune not to start the counter from zero when the "power-on" is reset.

$$SN = Q_2 \cdot (\bar{Q}_3 \cdot \bar{Q}_4 \cdot \bar{Q}_5) \cdot Q_6 \cdot Q_7 \cdot Q_8 \cdot Q_9 \cdot \bar{Q}_{10}$$

| $Q_{10}$ | $Q_9$ | $Q_8$ | $Q_7$ | $Q_6$ | $Q_5$ | $Q_4$ | $Q_3$ | $Q_2$ | $Q_1$ | $Q_0$ | |
|---|---|---|---|---|---|---|---|---|---|---|---|
| 1 | 1 | 1 | 1 | 0 | 0 | 0 | 0 | 0 | 0 | 0 | → AGG (1920) |
| 0 | 0 | 0 | 0 | 0 | 0 | 0 | 0 | 0 | 0 | 1 | |
| 0 | 0 | 0 | 0 | 0 | 0 | 0 | 0 | 0 | 1 | 0 | |
| 0 | 0 | 0 | 0 | 0 | 0 | 0 | 0 | 0 | 1 | 1 | |
| 0 | 0 | 0 | 0 | 0 | 0 | 0 | 0 | 1 | 0 | 0 | |
| 0 | 0 | 0 | 0 | 0 | 0 | 0 | 0 | 1 | 0 | 1 | $SN_2$ → 4/32 sec. |
| 0 | 0 | 0 | 0 | 0 | 0 | 0 | 0 | 1 | 1 | 0 | |
| 0 | 0 | 0 | 0 | 0 | 0 | 0 | 0 | 1 | 1 | 1 | |
| 0 | 0 | 0 | 0 | 0 | 0 | 0 | 1 | 0 | 0 | 0 | |
| . | . | . | . | . | . | . | . | . | . | . | |
| . | . | . | . | . | . | . | . | . | . | . | |
| . | . | . | . | . | . | . | . | . | . | . | |

$$AGG = Q_7 \cdot Q_8 \cdot Q_9 \cdot Q_{10}$$

State of the outputs on resetting:

| $Q_{10}$ | $Q_9$ | $Q_8$ | $Q_7$ | $Q_6$ | $Q_5$ | $Q_4$ | $Q_3$ | $Q_2$ | $Q_1$ | $Q_0$ | |
|---|---|---|---|---|---|---|---|---|---|---|---|
| 0 | 0 | 0 | 0 | 0 | 0 | 0 | 0 | 0 | 1 | 1 | |
| $Q_{10}$ | $Q_9$ | $Q_8$ | $Q_7$ | $Q_6$ | $Q_5$ | $Q_4$ | $Q_3$ | $Q_2$ | $Q_1$ | $Q_0$ | |
| 0 | 0 | 0 | 0 | 0 | 0 | 0 | 0 | 1 | 0 | 0 | $SN_2 \rightarrow 4/32$ sec. |
| 0 | 0 | 0 | 0 | 0 | 0 | 0 | 0 | 1 | 0 | 1 | |
| 0 | 0 | 0 | 0 | 0 | 0 | 0 | 0 | 1 | 1 | 0 | |
| 0 | 0 | 0 | 0 | 0 | 0 | 0 | 0 | 1 | 1 | 1 | |
| 0 | 0 | 0 | 0 | 0 | 0 | 0 | 1 | 0 | 0 | 0 | |
| . | . | . | . | . | . | . | . | . | . | . | |
| . | . | . | . | . | . | . | . | . | . | . | |
| . | . | . | . | . | . | . | . | . | . | . | |

$$SN_2 = Q_2 \cdot (\bar{Q}_3 \cdot \bar{Q}_4 \cdot \bar{Q}_5 \cdot \bar{Q}_6) \cdot \bar{Q}_7 \cdot \bar{Q}_8 \cdot \bar{Q}_9 \cdot \bar{Q}_{10}$$

| $Q_{10}$ | $Q_9$ | $Q_8$ | $Q_7$ | $Q_6$ | $Q_5$ | $Q_4$ | $Q_3$ | $Q_2$ | $Q_1$ | $Q_0$ | |
|---|---|---|---|---|---|---|---|---|---|---|---|
| 0 | 1 | 1 | 1 | 1 | 0 | 0 | 0 | 1 | 0 | 0 | |
| 0 | 1 | 1 | 1 | 1 | 0 | 0 | 0 | 1 | 0 | 1 | |
| 0 | 1 | 1 | 1 | 1 | 0 | 0 | 0 | 1 | 1 | 0 | $SN_1 \rightarrow (4/32 + 30)$ sec. |
| 0 | 1 | 1 | 1 | 1 | 0 | 0 | 0 | 1 | 1 | 1 | |
| 0 | 1 | 1 | 1 | 1 | 0 | 0 | 1 | 0 | 0 | 0 | |
| . | . | . | . | . | . | . | . | . | . | . | |
| . | . | . | . | . | . | . | . | . | . | . | |
| . | . | . | . | . | . | . | . | . | . | . | |

The decoding of the signal AGG, which is the signal enabling update of the direction of the pulse SN onto the outputs SN1 or SN2, shows that it is only active during normal operation. In fact, as pressure on the time-resetting push button resets the submodule CNT-11Bit, the latter will disable the decoding configuration of AGG (cf. the state of the outputs when the power-on is reset). In this case, the signal which directs SN to the appropriate output is QSX.

The signal SEC, at logic low between 1 and 2 seconds from the beginning of the cycle, is the signal which provides the indication for passing to fast time resetting. Decoding is given by the following relationship:

$$SEC = \overline{(\bar{Q}_{10} \cdot \bar{Q}_9 \cdot \bar{Q}_8) \cdot (\bar{Q}_7 \cdot \bar{Q}_6 \cdot \bar{Q}_5)}$$

which corresponds to the state of the outputs when the submodule CNT-11Bit has counted 32 transitions of the synchronism signal.

| $Q_{11}$ | $Q_{10}$ | $Q_9$ | $Q_8$ | $Q_7$ | $Q_6$ | $Q_5$ | $Q_4$ | $Q_3$ | $Q_2$ | $Q_1$ | $Q_0$ |
|---|---|---|---|---|---|---|---|---|---|---|---|
| 0 | 0 | 0 | 0 | 0 | 0 | 1 | 0 | 0 | 0 | 0 | 0 |

The signal SEC is activated in correspondence with the switching of the output $Q_5$ which corresponds to a frequency of 0.5 Hz; it should be noted that, in normal operation, the signal SEC changes to logic low 125 ms before the 1 second which is effective when, during resetting, the counter is reset to 00000000011 instead of 00000000000. This is not important since the signal SEC operates in the context of time resetting in which the instant which starts the counting of the "second" coincides with the instant in which the push button is pressed.

The signal INIB is activated at logic low for the first 7/32 seconds of the cycle and then changes to logic high in correspondence with the eighth transition of the synchronism signal (00000000100) from which is received:

$$INIB = \overline{(\bar{Q}_{10} \cdot \bar{Q}_9 \cdot \bar{Q}_8 \cdot \bar{Q}_7) \cdot (\bar{Q}_6 \cdot \bar{Q}_5 \cdot \bar{Q}_4 \cdot \bar{Q}_3)}$$

In order to perform this function in a circuit, it is sufficient to have a NAND gate with two inputs since the decoding uses the outputs of two AND gates with four inputs already used for generating the pulses SN1 and $SN_2$.

The function of this signal is to prevent possible action on the time resetting push button if it is pressed in correspondence with the period from when the signal AGG is activated (three periods before the beginning of the new cycle) until the pulse SN following the signal AGG is finished. This operation is rendered necessary since the action on the push button comprises the resetting of the submodule CNT-11Bit and the updating of the destination of the pulse SN; if this occurs after the updating action of the signal AGG, there will be a further updating which will return the multiplexer to the condition preceding AGG and the pulse will be directed to the incorrect output.

The submodule SELECT-OUT125 performs the function of a multiplexer which directs the signal SN alternately to the outputs SN1 and SN2. When the output signal QMUX has been obtained, the value of which is characterized by the output SN1 or SN2 previously activated, it is synchronized with the rising edge of the 32 Hz signal. The following logic table has been adopted for the production of this submodule:

| present state | AGG = 0 | | AGG = 1 | |
|---|---|---|---|---|
| $Q_n$ | $Q_n + 1$ | OUT | $Q_n + 1$ | OUT |
| 0 | 1 | 1 | 0 | 0 |
| 1 | 0 | 0 | 1 | 1 |

from which is obtained:

$$D = \overline{AGG} \cdot Q_n AGG \cdot Q_n$$

$$D = Q_n \oplus AGG$$

During normal operation, the 125 ms pulses SN are directed to the appropriate output of the multiplexer which, even during the fast time resetting phase, is updated by the signal QSX such that the pulse SN, which is present when the signal RFROV resets the submodule CNT-11Bit at the end of a "fast" time resetting phase, is directed to the correct output.

Thus, if, for example, the last pulse output from a "fast" time resetting phase has been directed to the output S1 (QSx=1), the pulse which will correspond to the resetting of the submodule CNT-11Bit should be directed to the output SN1.

To this end, logic circuits are present which, acting on the set and reset of a flip-flop performing this function, update its output during the "fast" time resetting phase.

The function actuated is represented in the following table:

| RFROV | QSX | RMUX | PRMUX |
|---|---|---|---|
| 0 | 0 | 1 | 0 |
| 0 | 1 | 0 | 1 |
| 1 | 1 | 1 | 1 |
| 1 | 0 | 1 | 1 |

from which is obtained:

$$RMUX = \overline{QSX \cdot \overline{Reset}}$$

$$PRMUX = \overline{\overline{QSX} \cdot \overline{Reset}}$$

where QSX is the sequence of pulses used for the fast time resetting phase whilst the signal RFROV is the signal which resets the submodule CNT-11Bit at the end of a fast time resetting phase.

The submodule ABILIT-50M is substantially a finite state machine. This submodule enables the pulses SX1 and SX2 as a function of the signals SEC, PTEMP (pressure on the "timed" push button of the anti-return device) and on the falling edge of SX.

If the time resetting push button is pressed for more than one second, the signal SECS is generated which is activated at logic 1, allowing the device to operate in fast time resetting conditions (sequence of 50 ms pulses at the outputs).

When the push button is released, the active signal RFROV is generated, at logic low, between the instant at which the signal PTEMP returns to logic high and the instant at which the signal SECS returns to logic low. These two events are both consecutive to the release of the push button but the first is synchronized with the falling edge of the 32 Hz signal (which in turn comes from a rising edge of the 1024 Hz signal) whilst the second, which is the consequence thereof, is synchronized with the falling edge of the 1024 Hz signal; in this way, possible "spikes" are avoided which, in view of the fact that the signal RFROV is one of the components of the signal which resets the principal counter of the submodule CNT-11Bit, could compromise the correct operation of the circuit.

The "condition table" and the logic equation producing the above-described function will now be described.

| | | |
|---|---|---|
| Conditions of normal operation: PTEMP = 1 | | |
| SEC = 0 | PTEMP = 1 | SECS = 0 |
| SEC = 1 | PTEMP = 1 | SECS = 0 |
| Conditions when push button pressed: PTEMP = 0 | | |
| SEC = 1 | PTEMP = 0 | SECS = 1 |
| SEC = 0 | PTEMP = 0 | SECS = 1 |

| present state | P = 0 S = 0 | | P = 0 S = 1 | | P = 1 S = 1 | | P = 1 S = 0 | |
|---|---|---|---|---|---|---|---|---|
| $Q_n$ | $Q_n + 1$ | D | $Q_n + 1$ | D | $Q_n + 1$ | D | $Q_n + 1$ | D |
| 0 | 0 | 0 | 1 | 1 | 0 | 0 | 0 | 0 |
| 1 | 1 | 1 | 1 | 1 | 0 | 0 | 0 | 0 |

The submodule PULSE-RH is a finite state machine, synchronized with the falling edge of the 32 Hz signal. This submodule controls the signals IMP and PTEMP as a function of the state of the time resetting push button (PULSE) and the signal INIB.

From the action on the time resetting push button (PULSE=0), if it is present for a period of between 62.5 and 93.75 ms (anti-return period of the push button) and provided that the INIB signal is not activated, the signal PTEMP is generated ("timed" push button) which confirms the action on the push button after the anti-return period; this signal remains at logic low until the push button is released.

Simultaneously with the signal PTEMP, the signal IMP is generated. This signal normally at logic high, but, during this phase, it is brought to logic low for 31.25 ms, thus resetting the submodule CNT-11Bit with the subsequent activation of a pulse SN which advances the hand by one minute.

Naturally, the principle of the invention remaining the same, the features of production and forms of embodiment can be widely varied with respect to what has been described and illustrated above, without departing from the scope of the present invention.

What is claimed is:

1. An electronic circuit for controlling selectively the inversion of the direction of current in the motor activating a clock, the circuit comprising:

control outputs for supplying respective control signals for controlling said current inversion;

first counter circuitry for supplying to said control outputs first control signals for controlling the current inversion at a first frequency corresponding to a normal clock operating rate;

second counter circuitry for supplying to said control outputs second control signals for controlling the current inversion at a second frequency, greater than the first frequency for performing fast setting of clock time; and a first multiplexer interposed between (i) said first and second counter circuitry and (ii) said control outputs, and selectively actuable to transfer to said control outputs the second control signals instead of the first control signals outputs for setting the clock time;

pulse signal generating circuitry for generating at least one counting signal of predetermined frequency, said first counter circuitry comprising a counter synchronous with a given bit number, with an operating cycle of given length and responsive to said counting signal for generating:

a first basic signal for generating said first control signals, which signal assumes a respective first active logic value at first intervals of given duration from the beginning of said operating cycle;

a second signal which assumes a respective second active logic value in a second predetermined interval after the beginning of said operating cycle, for activating fast setting of the clock time;

a third signal which assumes a respective third active logic value at the beginning of said operating cycle for preventing the switching of the multiplexer to a state in which said second control signals are transferred to said control outputs during transmission thereto of said first control signals;

a fourth signal which assumes a respective fourth active logic level at the beginning of said operating cycle for updating the direction of said first control signals to said control outputs.

2. A circuit according to claim 1, wherein the second counter circuitry comprises:

a further counter operable to generate from at least said counting signal, a second basic signal; and a second multiplexer operable to generate said second control signals from a second basic signal by alternating the basic signal at said first and second multiplexer outputs of said second counter circuitry, and further operable to generate a selection signal indicating which of said first and second multiplexer outputs is the last used.

3. A circuit according to claim 1, wherein said first counter circuitry is arranged to receive, as input, an input signal indicating activation of a push button for setting the clock time, said first counter circuitry comprising discriminator circuitry arranged to activate selectively said clock time setting in at least two different ways including:

a first slower way, activated when pressure is applied to said push button; and a second faster way, activated when said push button is pressed continuously over at least a predetermined time interval.

4. A circuit according to claim 1, wherein said synchronous counter generates a pulse on its first basic signal every 960 periods of said counting signal of which there is at least one.

5. A circuit according to claim 1, wherein said synchronous counter is a counter with 11 bits.

6. A circuit according to claim 1, wherein said synchronous counter is arranged such that said first basic signal assumes said first active logic value for a brief predetermined time interval, every 30 seconds.

7. An electronic circuit for controlling selectively the inversion of the direction of current in the motor activating a clock, the circuit comprising:

control outputs for supplying respective control signals for controlling said current inversion;

first counter circuitry for supplying to said control outputs first control signals for controlling the current inversion at a first frequency corresponding to a normal clock operating rate;

second counter circuitry for supplying to said control outputs second control signals for controlling the current inversion at a second frequency, greater than the first frequency for performing fast setting of clock time; and a first multiplexer interposed between (i) said first and second counter circuitry and (ii) said control outputs, and selectively actuable to transfer to said control outputs the second control signals instead of the first control signals outputs for setting the clock time;

pulse signal generating circuitry for generating at least one counting signal of predetermined frequency, said first counter circuitry comprising a counter synchronous with a given bit number, with an operating cycle of given length and responsive to said counting signal for generating:

a first basic signal for generating said first control signals, which signal assumes a respective first active logic value at first intervals of given duration from the beginning of said operating cycle;

a second signal which assumes a respective second active logic value in a second predetermined interval after the beginning of said operating cycle, for activating fast setting of the clock time;

a third signal which assumes a respective third active logic value at the beginning of said operating cycle for preventing the switching of the multiplexer to a state in which said second control signals are transferred to said control outputs during transmission thereto of said first control signals;

a fourth signal which assumes a respective fourth active logic level at the beginning of said operating cycle for updating the direction of said first control signals to said control outputs;

wherein said first counter circuitry is arranged to receive, as input, an input signal indicating activation of a push button for setting the clock time, said first counter circuitry comprising discriminator circuitry arranged to activate selectively said clock time setting in at least two different ways including:

a first slower way, activated when pressure is applied, to said push button; and a second faster way, activated when said push button is pressed continuously over at least a predetermined time intervals;

wherein said first counter circuitry further comprises sequential logic circuitry which is arranged to generate, when said third signal assumes an inactive logic value:

a fifth signal which assumes a fifth low active logic level for a second predetermined time interval when said push button has been pressed for at least a third predetermined time interval; and a sixth signal which assumes a sixth low active logic level simultaneously with said fifth signal and maintains it for the entire duration of pressure on said push button.

8. A circuit according to claim 7, wherein said discriminator circuitry is operable to generate:

a seventh signal which assumes a seventh low active logic value when the continuous pressure on said push button exceeds the first predetermined time interval; and an eighth signal which assumes an eighth low active logic value in a time interval between return of said sixth signal to a high logic value and return of said seventh signal to a low logic value.

9. A circuit according to claim 8, wherein said first counter circuitry comprises first combiner logic circuitry arranged to direct said first basic signal to one of two outputs as a function of:

a selection signal;

said eighth signal; and said fourth signal.

10. A circuit according to claim 7, wherein said first counter circuitry comprises combiner logic circuitry configured to generate a ninth signal for resetting said synchronous counter as a function of:

a resetting signal by virtue of the supply to the circuit;

said fifth signal;

said eighth signal;

an input signal.

11. A circuit according to claim 10, wherein said second combiner logic circuitry comprises an AND gate having four inputs for receiving respectively:

said resetting signal;

said fifth signal;

said eighth signal; and said input signal.

12. A circuit according to claim 5, wherein when said 11-bit counter is reset, its outputs adopt the following configuration:

| $Q_{10}$ | $Q_9$ | $Q_8$ | $Q_7$ | $Q_6$ | $Q_5$ | $Q_4$ | $Q_3$ | $Q_2$ | $Q_1$ | $Q_0$ |
|---|---|---|---|---|---|---|---|---|---|---|
| 0 | 0 | 0 | 0 | 0 | 0 | 0 | 0 | 0 | 1 | 1 |

$Q_{10}$ representing the most significant bit and $Q_0$ representing the least significant bit; and said 11-bit counter is arranged to generate from said configuration said control signals when the following configurations are attained:

| | $Q_{10}$ | $Q_9$ | $Q_8$ | $Q_7$ | $Q_6$ | $Q_5$ | $Q_4$ | $Q_3$ | $Q_2$ | $Q_1$ | $Q_0$ | |
|---|---|---|---|---|---|---|---|---|---|---|---|---|
| a) | 0 | 0 | 0 | 0 | 0 | 0 | 0 | 0 | 1 | 0 | 0 | $SN_2$ |
| b) | 0 | 1 | 1 | 1 | 1 | 0 | 0 | 0 | 1 | 0 | 0 | $SN_1$ |
| c) | 1 | 1 | 1 | 1 | 0 | 0 | 0 | 0 | 0 | 0 | 0 | AGG |
| d) | 0 | 0 | 0 | 0 | 0 | 0 | 0 | 0 | 1 | 1 | 0 | $SN_2$ |

and when the configuration c) is attained, the selection of said output of said first counter means toward which the pulses (SN1, SN2) are directed, is changed by the fourth signal and the 11-bit counter is reset.

13. A circuit according to claim 12, wherein said second signal is generated according to the following logic function:

$$SEC = \overline{(\overline{Q}_{10} \cdot \overline{Q}_9 \cdot \overline{Q}_8) \cdot (\overline{Q}_7 \cdot \overline{Q}_6 \cdot \overline{Q}_5)}.$$

14. A circuit according to claim 12, wherein said second signal is generated according to the following logic function:

$$INIB = \overline{(\overline{Q}_{10} \cdot \overline{Q}_9 \cdot \overline{Q}_8 \cdot \overline{Q}_7) \cdot (\overline{Q}_6 \cdot \overline{Q}_5 \cdot \overline{Q}_4 \cdot \overline{Q}_3)}.$$

15. A circuit according to claim 12, wherein said fourth signal is generated according to the following function:

$$AGG = Q_7 \cdot Q_8 \cdot Q_9 \cdot Q_{10}.$$

16. A circuit according to claim 9, wherein said first combiner logic circuitry is arranged to feed said first basic signals to one of the said control outputs according to the following plan:

| present state | AGG = 0 | | AGG = 1 | |
|---|---|---|---|---|
| $Q_n$ | $Q_n + 1$ | OUT | $Q_n + 1$ | OUT |
| 0 | 1 | 1 | 0 | 0 |
| 1 | 0 | 0 | 1 | 1 |

Qn being the actual output of said first combiner logic and $Q_{n+1}$, coinciding with OUT, being the future output, and AGG being said fourth signal.

17. An electronic circuit arrangement for controlling an electronic clock movement which is operable by non-inverted and inverted current pulses generated in response to received control pulses, wherein the arrangement comprises:

control pulse outputs for non-inverting and inverting control pulses respectively;

first counter circuitry for supplying said control pulses at a first frequency corresponding to a normal clock operating rate;

second counter circuitry for supplying said control pulses at a second frequency which is greater than the first frequency for fast setting of the indicated clock time; and a multiplexer interposed between, firstly, said first and second counter circuitry and, secondly, said control pulse outputs, and selectively actuable to feed to said outputs said control pulses either from said first counter circuitry or from said second counter circuitry according to whether the clock is to be driven at the normal clock operating rate or at a clock-time-setting rate;

pulse signal generating circuitry for generating at least one counting signal of predetermined frequency, said first counter circuitry comprising a counter synchronous with a given bit number, with an operating cycle of given length and responsive to said counting signal for generating:

a first basic signal for generating said first control signals, which signal assumes a respective first active logic value at first intervals of given duration from the beginning of said operating cycle;

a second signal which assumes a respective second active logic value in a second predetermined interval after the beginning of said operating cycle, for activating fast setting of the clock time;

a third signal which assumes a respective third active logic value at the beginning of said operating cycle for preventing the switching of the multiplexer to a state in which said second control signals are transferred to said control outputs during transmission thereto of said first control signals;

a fourth signal which assumes a respective fourth active logic level at the beginning of said operating cycle for updating the direction of said first control signals to said control outputs.

* * * * *